US008322524B2

(12) United States Patent
Mazur

(10) Patent No.: US 8,322,524 B2
(45) Date of Patent: Dec. 4, 2012

(54) CIGARETTE BOX AND ITS BLANK

(75) Inventor: Wojciech Mazur, Wroclaw (PL)

(73) Assignee: Wojciech Mazur, Wroclaw (PL)

( * ) Notice: Subject to any disclaimer, the term of this patent is extended or adjusted under 35 U.S.C. 154(b) by 1195 days.

(21) Appl. No.: 11/658,465

(22) Filed: Jan. 24, 2007

(65) Prior Publication Data

US 2010/0270182 A1 Oct. 28, 2010

(30) Foreign Application Priority Data

Sep. 17, 2004 (PL) ..... P370152

(51) Int. Cl.
*B65D 85/10* (2006.01)

(52) U.S. Cl. ..... 206/93; 206/273; 206/92; 206/268

(58) Field of Classification Search ..... 206/242, 206/256, 264, 265, 268, 271, 273, 246, 775, 206/783, 92, 93; 229/120.08
See application file for complete search history.

(56) References Cited

U.S. PATENT DOCUMENTS

| | | | | | |
|---|---|---|---|---|---|
| 1,232,404 | A * | 7/1917 | Stankewitz | 220/315 |
| 1,619,622 | A * | 3/1927 | MacVey | 206/93 |
| 1,726,843 | A * | 9/1929 | Kornsweet | 206/92 |
| 2,351,223 | A * | 6/1944 | Neivert | 206/93 |
| 2,447,787 | A * | 8/1948 | Atkinson | 206/92 |
| 2,894,619 | A * | 7/1959 | Gallo | 206/93 |
| 2,929,542 | A * | 3/1960 | O'Gorman | 206/268 |
| 2,944,555 | A * | 7/1960 | Peel et al. | 206/246 |
| 2,975,890 | A * | 3/1961 | Block | 206/92 |
| 3,011,630 | A * | 12/1961 | Lubash | 206/93 |
| 3,587,837 | A * | 6/1971 | Smith et al. | 206/387.11 |
| 4,164,999 | A * | 8/1979 | Tsukamoto | 206/91 |
| 4,466,534 | A * | 8/1984 | Dunn | 206/777 |
| 4,895,251 | A * | 1/1990 | Focke et al. | 206/273 |
| 5,236,084 | A * | 8/1993 | Evers | 206/273 |
| 6,059,113 | A * | 5/2000 | Hodges | 206/443 |
| 7,455,177 | B2 * | 11/2008 | Serafini et al. | 206/268 |
| 2005/0082178 | A1 * | 4/2005 | Draghetti et al. | 206/242 |

* cited by examiner

*Primary Examiner* — Andrew Perreault
(74) *Attorney, Agent, or Firm* — Gary J. Gershik; Cooper & Dunham LLP

(57) ABSTRACT

A cigarette box, of a rectangular prism shape, formed of a storage part adapted to accommodate cigarettes within and a hinged lid connected with the said storage part by means of an articulated joint placed on the rear wall. The front wall of the lid is longer than its rear wall, and the side walls are oblique. The storage part, is provided with an additional inside front wall (7) and the outside front wall (8) of the storage part is hinged. Between the hinged front wall (8) and the inside front wall (Z) there is an additional compartment useful for matches (9), lighters or other objects. The inside front wall (7) has two extrusion ridges (10, 11) oriented towards the box interior, where the lower extrusion ridge forms the storage space. The outside front wall is made of the same substance as the box and may feature an extrusion ridge (17) oriented towards the outside which would form an additional storage space.

16 Claims, 18 Drawing Sheets

CIGARETTE BOX AND ITS BLANK

Figure 1:
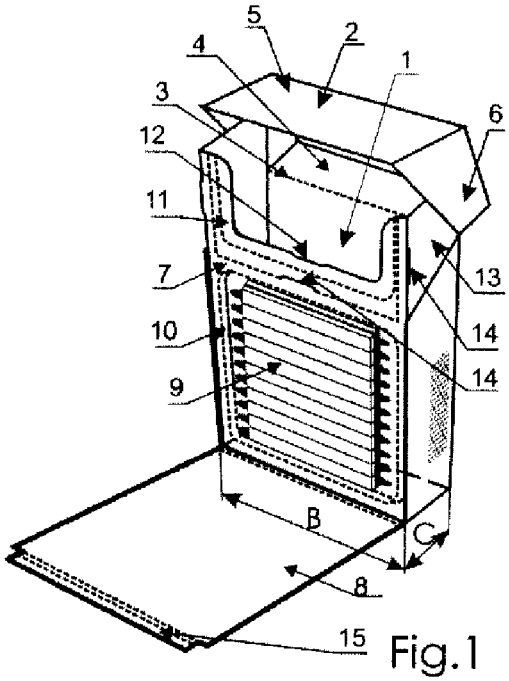
Figure 1A:
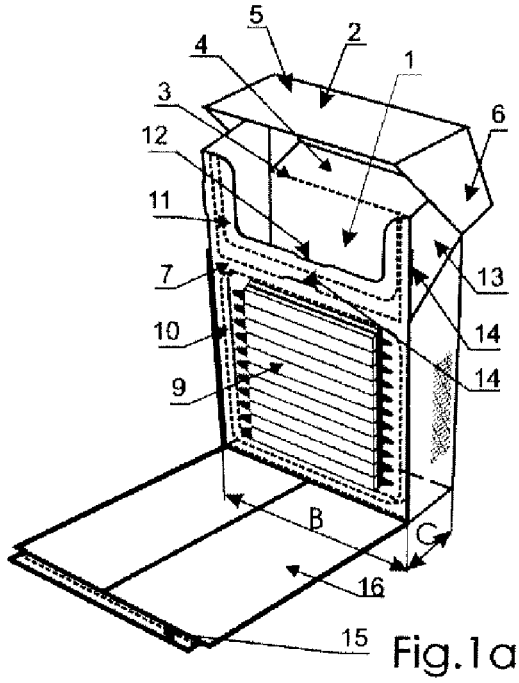
Figure 1B:
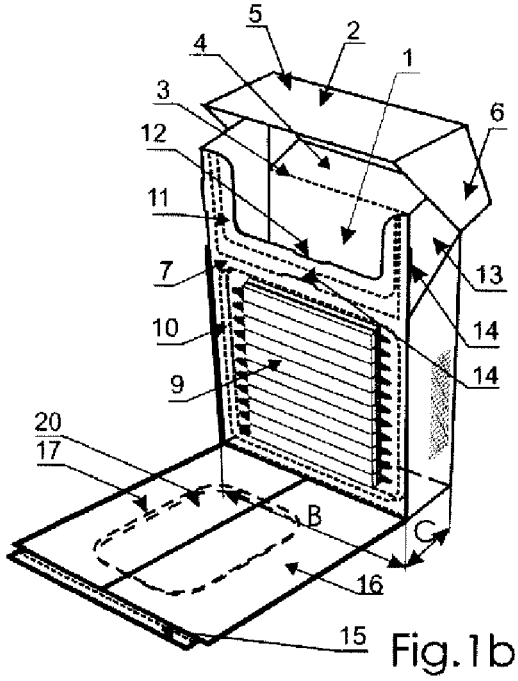

This application is a §371 national stage of PCT International Application No. PCT/PL2005/000044, filed Jul. 14, 2005, claiming priority of P370152, filed Sep. 17, 2004, the contents of all of which are hereby incorporated by reference into this application.

The subject matter of the invention is a cigarette box with a hinged lid and its blank.

The cigarette box and its blank as presented in the description filed under nr. P-355833 is commonly known. The box appears in the shape of a rectangular prism and has a hinged lid. It is formed of a storage space designated to contain cigarettes within and a hinged lid joined with the storage space by means of an articulated joint placed on the rear wall, whereas the front wall of the lid is longer than the rear wall and the side walls are oblique. The box is characterized, in that the storage space is provided with an additional inside front wall, while the outside front wall of the storage part is hinged, whereat between the hinged front wall and the inside front wall there is an additional storage space. Within the storage space a plurality of matches is installed. The hinged outside front wall features some fixing substance along its edges. The inside front wall also features fixing substance along its edge. The hinged outside front wall has got its edge placed under the lid of the cigarette box. The edges of the inside side walls are attached to the inside front wall. The edges of the inside side walls and angular walls are attached to the inside front wall. The matches are located alongside the box. The matches are located crosswise the box. The matches are attached to the hinged front wall. The matches are attached to the inside front wall.

The cigarette box, according to the invention, has a hinged lid and a shape of a rectangular prism, formed of a storage space intended to store cigarettes within and a hinged lid joined to the storage part by means of an articulated joint connected to the rear wall, whereas the front wall is longer that its rear counterpart and the side walls are oblique. The storage space, however, is provided with an additional inside front wall and the outside front wall of the storage space is hinged, whereas between the hinged front wall and the inside front wall there is an additional storage space useful for matches, a lighter or other objects. The inside front wall has two extrusion ridges oriented towards the interior of the box, of which the lower extrusion ridge of the inside front wall forms a storage space whereas the outside front wall features a narrowed end folded under in the direction of the interior of the box. The cigarette box is characterized in that, the front wall is made of the same substance as the box and/or semi-transparent substance and/or transparent substance and/or features an extrusion ridge 17 oriented towards the outside, which forms an additional storage space.

The outside wall with an extrusion ridge or without one is double.

Within the extrusion ridge oriented towards the outside of the box a storage space is formed, useful for placement of a lighter or other objects within.

On the front wall, within the extrusion ridge oriented towards the outside of the box, or with no extrusion ridge, a cut-out is formed, and/or within said cut-out an insert made of semitransparent or transparent substance is placed.

The depth of the box is increased by the magnitude of 10>X>0.1 mm—of the storage space for matches 9, where said magnitude fulfills dependence of B: A=B: (C−X) where;

B—width of the box

A—former depth of the box

C—increased depth of the box

X—storage space for matches and at the same time the inside front wall has two extrusion ridges oriented towards the box interior, while the outside front wall has a narrowed end folded under oriented towards the inside of the box, or/and the depth of the box is decreased by the magnitude of −10<X<=0 mm—of the storage space for matches 9, where said magnitude fulfills dependence of B: A=B: (C−X) where;

B—width of the box

A—former depth of the box

C—decreased depth of the box

X—depth of the storage space for matches for the magnitude of −10<X<=0 mm, at the same time the inside front wall has two extrusion ridges oriented towards the box interior, whereas the outside front wall 8 has a narrowed end folded under towards the box interior.

The depth of the box A is increased by the magnitude of 10>X>0.1 mm—of the storage space for matches, showing the magnitude of 10>Y=0, where said magnitudes fulfill dependence of B: A=B: ((C−X)−Y) where;

B—width of the box

A—former depth of the box

C—increased depth of the box

X—depth of the storage space for matches for the magnitude of 10>X>0.1 mm,

Y—additional storage space within the hinged lid—the depth protruded outwardly beyond the volume of the box for the magnitude of 10>Y>=0, at the same time the inside front wall has two extrusion ridges oriented towards the box interior, whereas the outside front wall has a narrowed end folded under towards the box interior.

The depth of the box is decreases by the magnitude of: —10<X<=0 mm—of the storage space and increased by the protrusion of Y, whereas the magnitude Y has a value of: 10>Y>=0, where said magnitudes fulfill dependence of B: A=B: ((C−X)—Y) where;

B—width of the box

A—former depth of the box

C—increased depth of the box

X—depth of the storage space for matches (9) for the magnitude of: −10<X<0 mm Y—additional storage space within the hinged lid—the depth protruded outwardly beyond the volume of the box for the magnitude of 10>Y>=0, at the same time the inside front wall has two extrusion ridges oriented towards the box interior, whereas the outside front wall has a narrowed end folded under towards the box interior.

The cigarette box, according to the invention, has a hinged lid and a shape of a rectangular prism, formed of a storage space intended to store cigarettes within and a hinged lid joined to the storage part by means of an articulated joint connected to the rear wall, whereas the front wall is longer that its rear counterpart. The side walls are oblique while the storage space is provided with an additional inside front wall and the outside front wall of the storage space is hinged, whereas between the hinged front wall and the inside front wall there is an additional storage space useful for matches, a lighter or other objects. The inside front wall has two extrusion ridges oriented towards the interior of the box, of which the lower extrusion ridge of the inside front wall forms a storage space whereas the outside front wall features a narrowed end folded under in the direction of the interior of the box. The cigarette box is characterized in that, the front wall is made of the same substance as the box and/or semi-transparent substance and/or transparent substance and/or features an extrusion ridge oriented towards the outside, which forms and additional storage space, while within the storage space matches favorably made of cardboard are installed, whereat the match heads are situated reversely in each of the rows.

A blank to obtain a cigarette box, according to the invention, with a hinged lid in the shape of a rectangular prism, formed of a storage part adapted to accommodate cigarettes within and a hinged lid connected with said storage part by means of an articulated joint located on the rear wall, where the front wall of the lid is longer than its rear wall, and the side walls are oblique. Within the space of the longitudinally spread blank of the cigarette box the following walls are situated: front, upper and bottom with attached thereto side walls, whereas the lid walls, rear storage space wall together with attached thereto side walls are adjacent, and the rear wall adjoins the bottom wall, whereas said bottom wall is adjacent to the front storage space wall. The box features additional cut-out in the inside part formed of the inside front wall and adjacent side walls and the bottom wall. The box is characterized in that, the front wall of the storage part is made of the same substance as the box and/or semitransparent substance and/or transparent substance and/or has an extrusion ridge oriented towards the outside of the box.

The front wall of the box has two additional side walls, whereat the side walls are shorter than the front wall and the additional side walls have extrusion ridges or have no extrusion ridges.

The front wall and/or the side walls have a cut-out in the extrusion ridge.

A blank to obtain a cigarette box, according to the invention, with a hinged lid in the shape of a rectangular prism, formed of a storage part adapted to accommodate cigarettes within and a hinged lid connected with said storage part by means of an articulated joint located on the rear wall. The front wall of the lid is longer than its rear wall and the side walls are oblique, whereat within the space of the longitudinally spread blank of the cigarette box the following walls are situated: front, upper and bottom with attached thereto side walls. The lid walls, rear storage space wall together with attached thereto side walls are adjacent, and the rear wall adjoins the bottom wall, whereas said bottom wall is adjacent to the front storage space wall. The box features additional cut-out in the inside part formed of the inside front wall and adjacent side walls and the bottom wall, whereas the splices of the following walls: the front and the rear ones joining the side walls have creases. The box is characterized in that, the side walls adjacent to the rear wall feature additional flaps and the splice of said elements has creases, whereat the side wall and the flap feature reverse creases.

The box as presented according to the invention, features trouble-free construction, while fulfilling three crucial functions: accommodate cigarettes, matches to make use of the cigarettes, and a lighter. This has been achieved thanks to an additional feature of the box aimed at and allowing storage of a lighter within. Furthermore, said additional feature of the package, which may incorporate a cut-out, provides a possibility of visual presentation of the content of the box.

The cigarette box as described in the invention is presented in detail in the drawing and in examples of realization.

FIG. 1, FIG. 1*a*, FIG. 1*b*, FIG. 1*c*, FIG. 1*d*, FIG. 1*e*, FIG. 1*f*, FIG. 1*g* disclose the cigarette box in axonometric view, in a variety of realizations, with the front wall and the hinged lid open.

FIG. 2, FIG. 2*a*, FIG. 2*b*, FIG. 2*c*, FIG. 2*d*, FIG. 2*e*, FIG. 2*f* and FIG. 2*g* show the main blank of an outer envelope in a variety of realizations, whereas FIG. 3, FIG. 3*a*, FIG. 3*b*, FIG. 3*c* present side-views of the box in various realizations, whereas FIG. 4, FIG. 4*a*, FIG. 4*b*, FIG. 4*c*, FIG. 4*d*, FIG. 4*e*, FIG. 4*f* and FIG. 4*g* present the cut-outs of the inner front wall of the box with the adjoining walls in a variety of versions.

FIG. 5, FIG. 5*a*, FIG. 5*b*, FIG. 5*c*, FIG. 5*d*, FIG. 5*e*, FIG. 5*f* and FIG. 5*g* disclose the cigarette box in axonometric view, in a variety of realizations, with the front wall and the hinged lid open and yet another version of the front wall.

Figure 5:
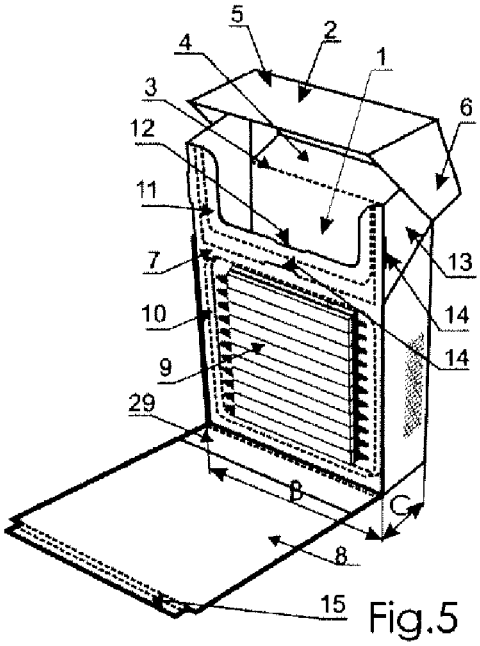
Figure 5A:
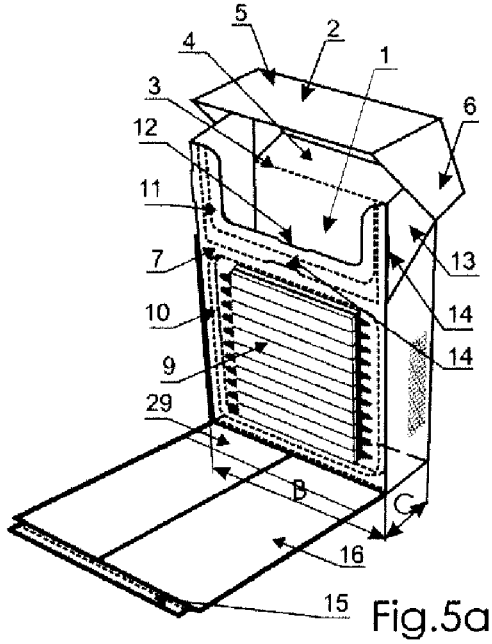
Figure 5B:
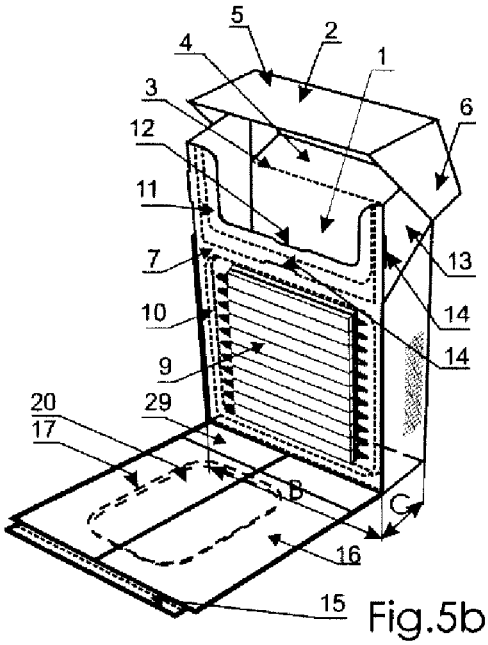
Figure 5C:
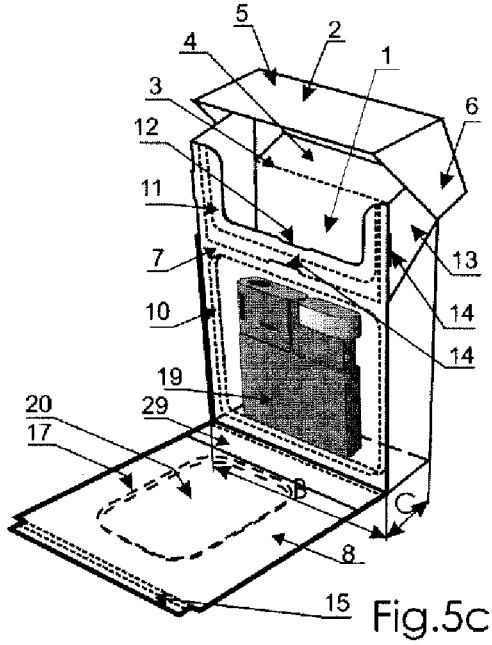
Figure 5D:
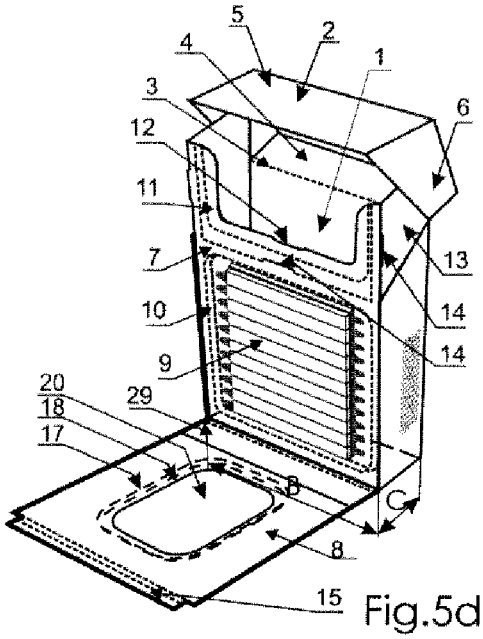
Figure 5E:
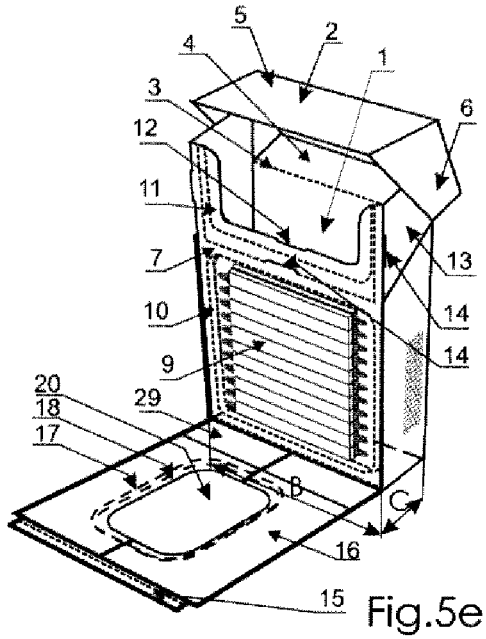
Figure 5F:
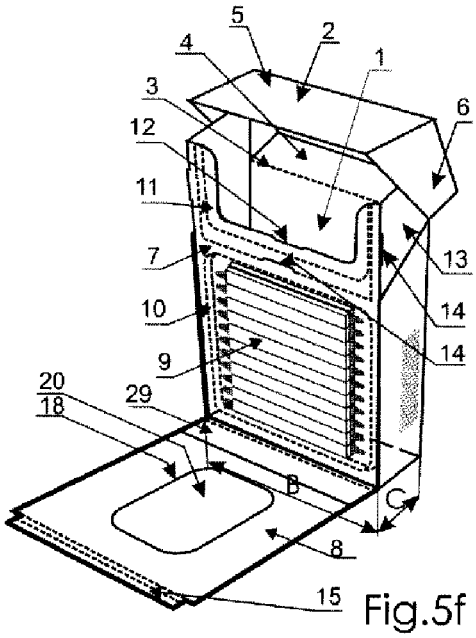
Figure 5G:
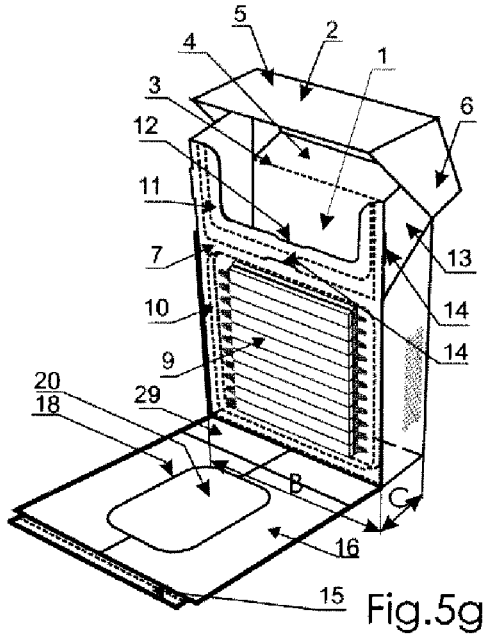

FIG. 6, FIG. 6*a*, FIG. 6*b*, FIG. 6*c*, FIG. 6*d*, FIG. 6*e*, FIG. 6*f* and FIG. 6*g* present blanks of the body of the box in various realizations, whereat these are blanks presented in FIG. 5-FIG. 5*g*.

Figure 7:
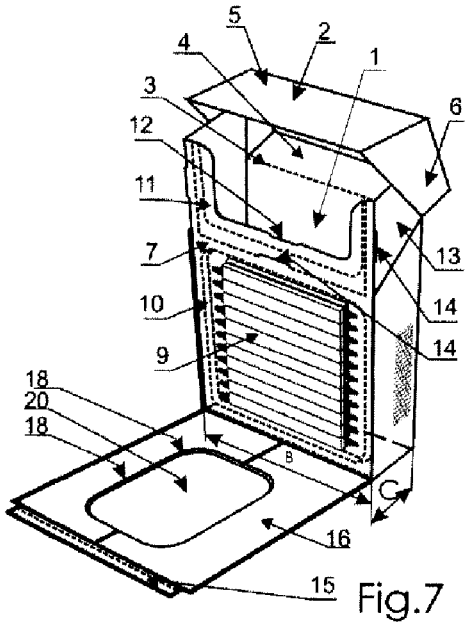
Figure 7A:
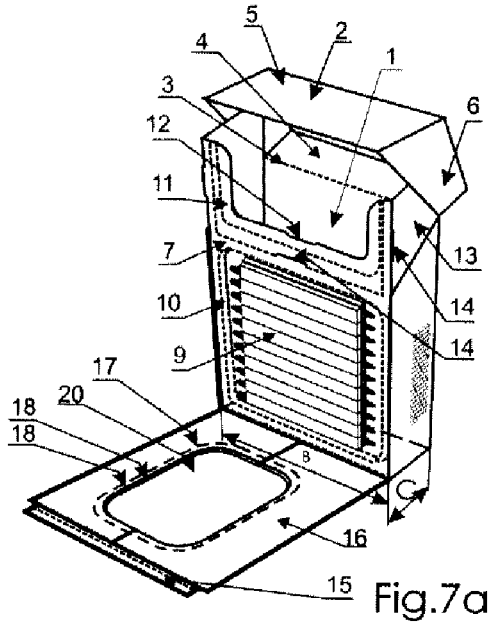
Figure 7B:
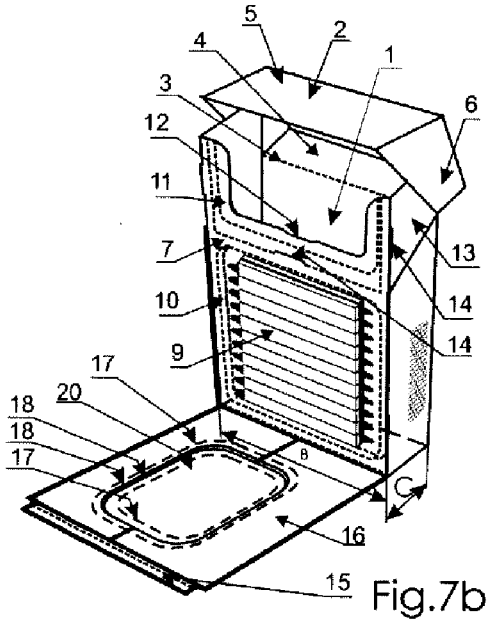
Figure 7C:
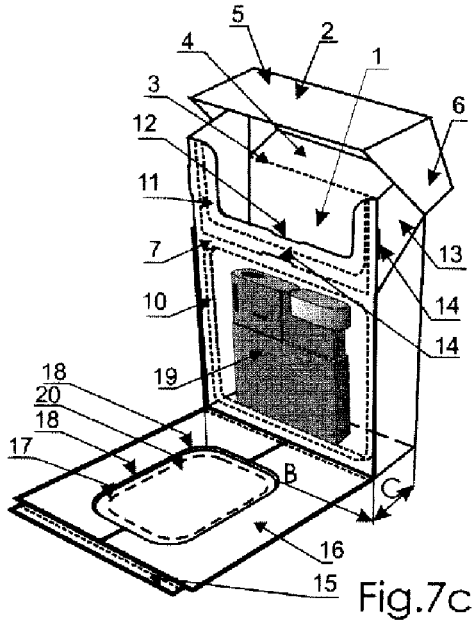
Figure 7D:
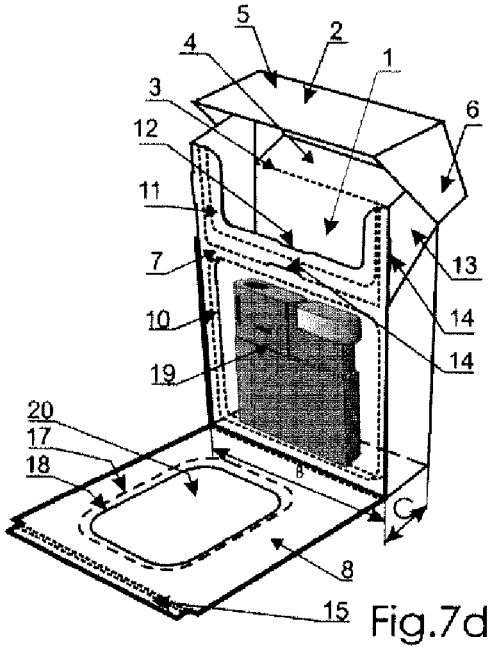
Figure 7E:
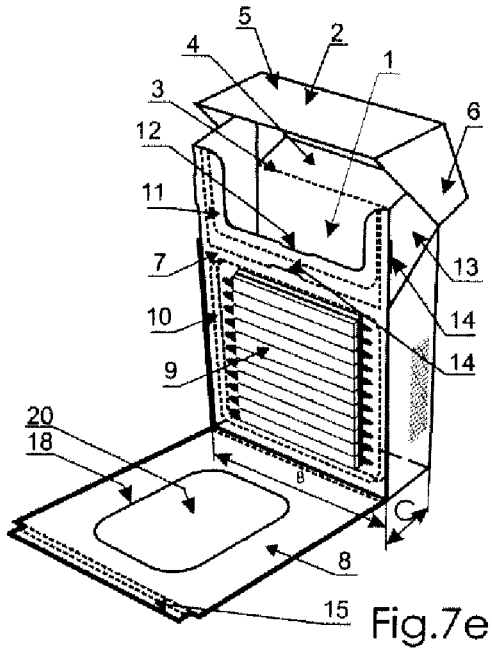
Figure 7F:
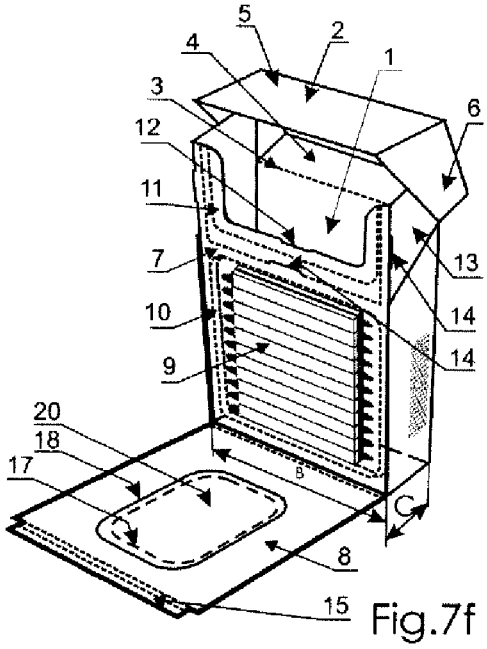
Figure 7G:
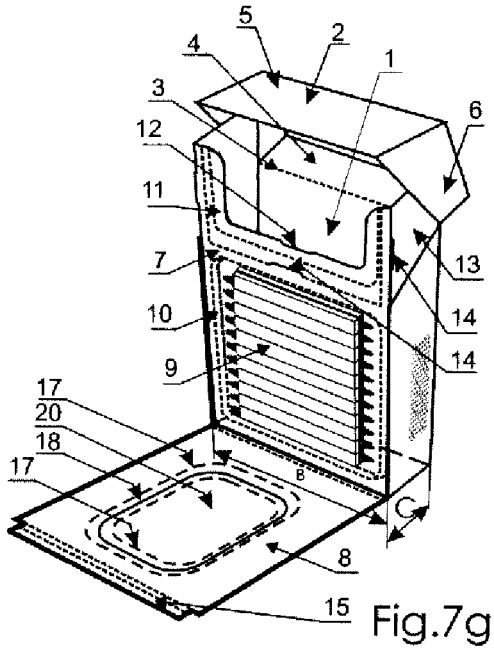
Figure 8:
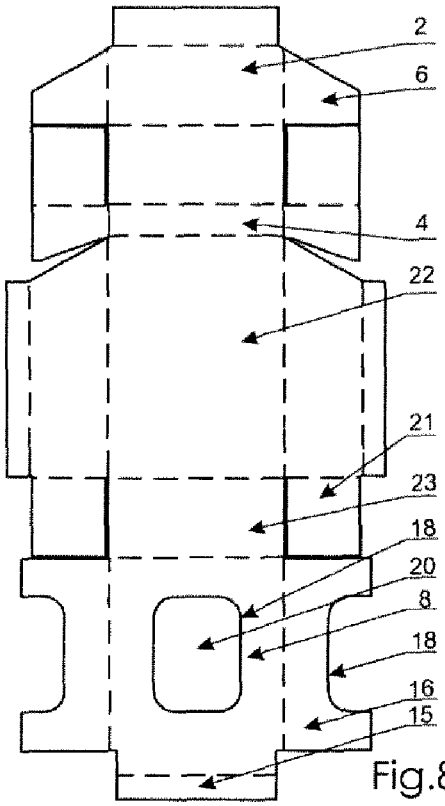
Figure 8A:
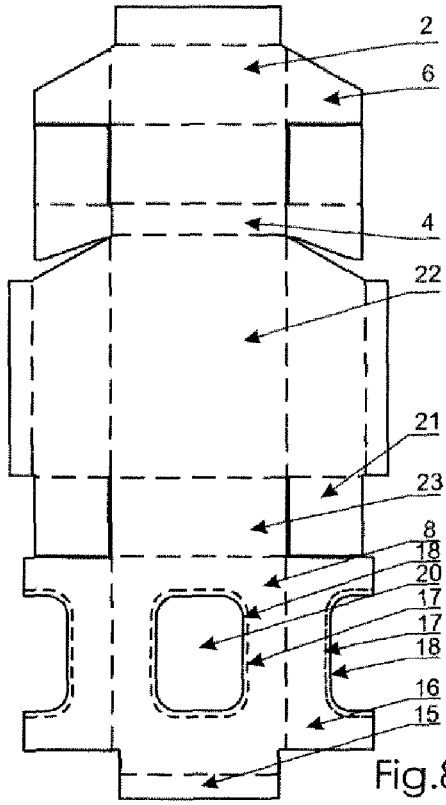
Figure 8B:
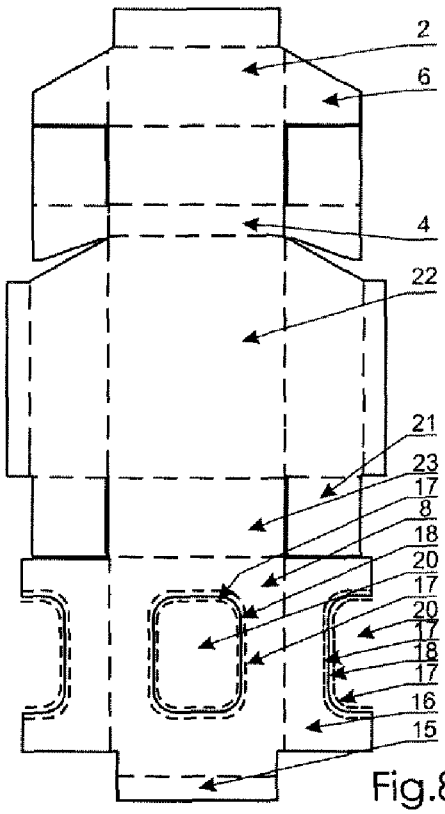
Figure 8C:
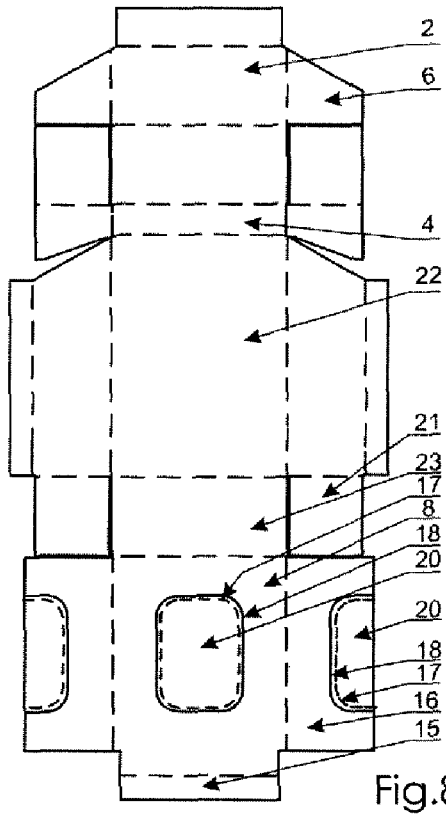
Figure 8D:
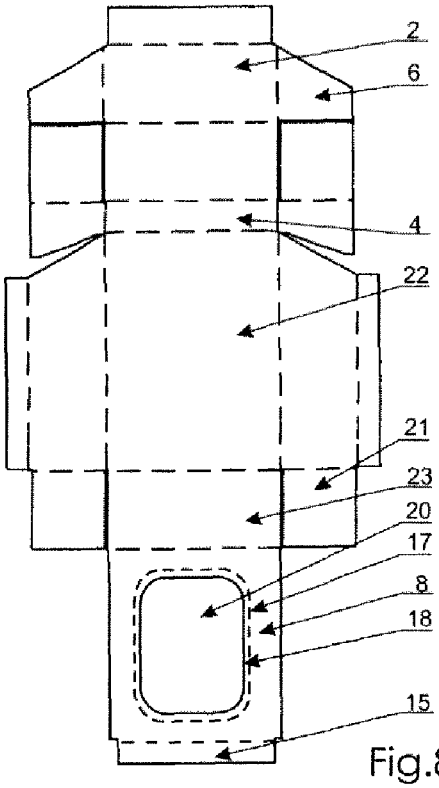
Figure 8E:
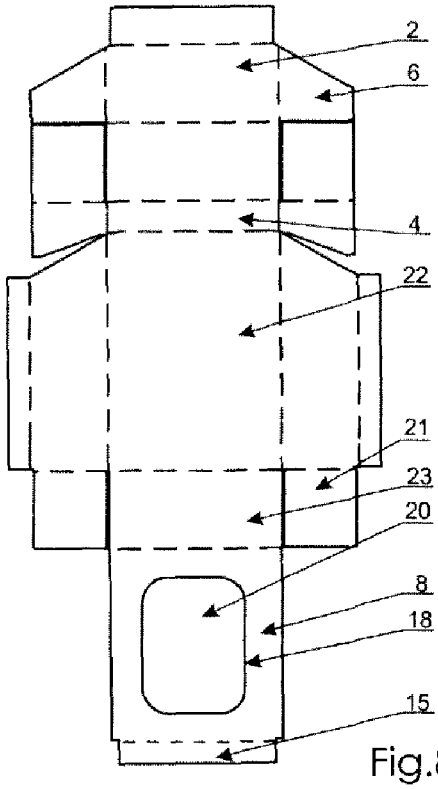
Figure 8F:
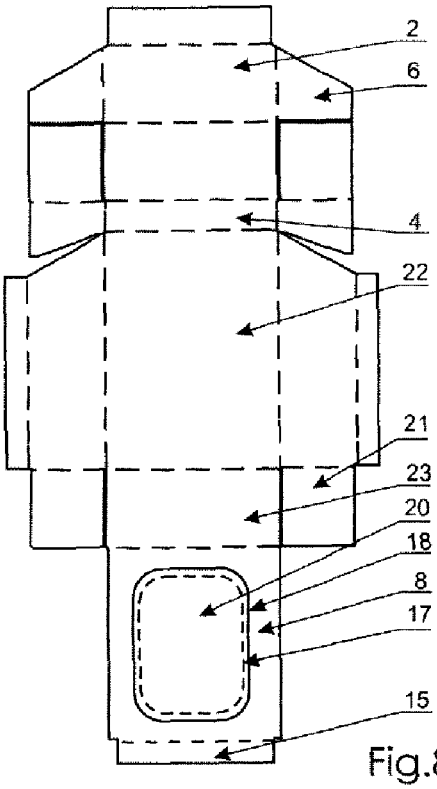
Figure 8G:
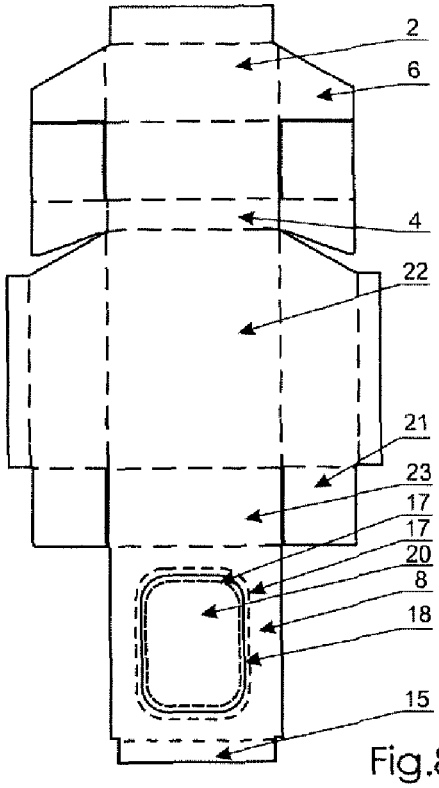

FIG. 7, FIG. 7*a*, FIG. 7*b*, FIG. 7*c*, FIG. 7*d*, FIG. 7*e*, FIG. 7*f* and FIG. 7*g* disclose the cigarette box in axonometric view, in a variety of realizations, with the front wall and the hinged lid open and yet another version of the front wall, FIG. 8, FIG. 8*a*, FIG. 8*b*, FIG. 8*c*, FIG. 8*d*, FIG. 8*e*, FIG. 8*f* & FIG. 8*g* disclose blanks of the body of the box in various realizations, whereat these are the blanks presented in FIG. 7-FIG. 7*g*.

Figure 9:
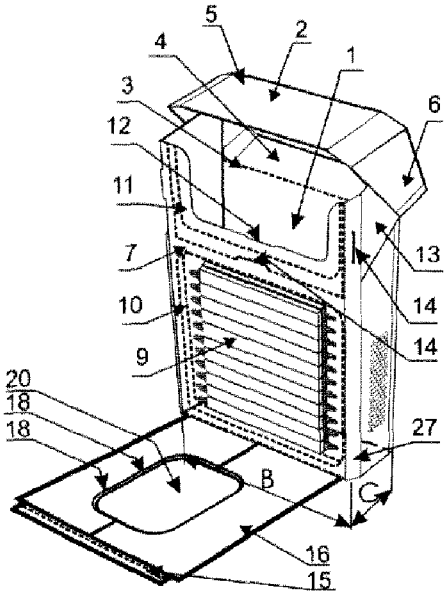
Figure 9A:
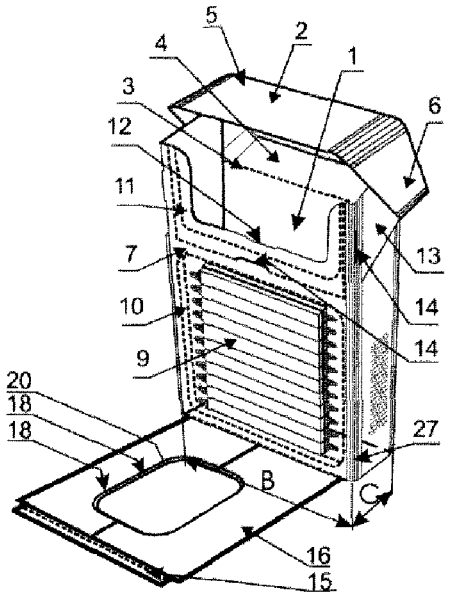

FIG. 9 discloses the box with its edges oblique, whereas FIG. 9*a*—with the edges creased.

Figure 10:
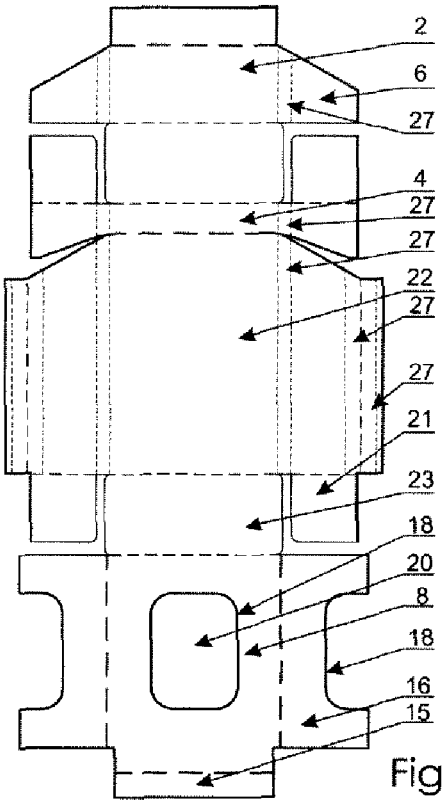
Figure 10A:
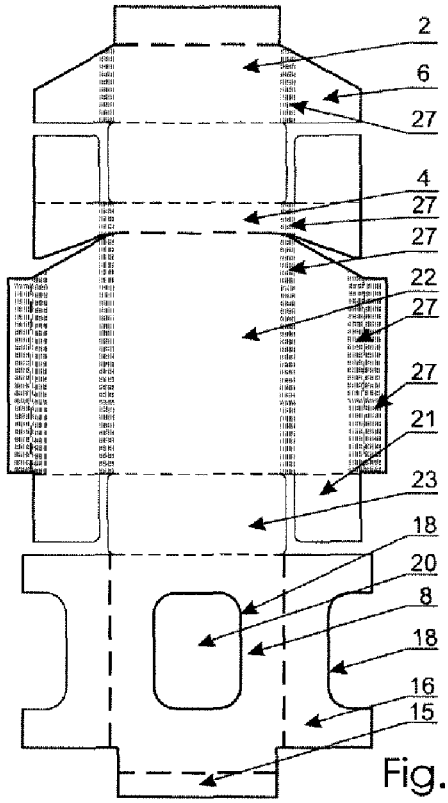

FIG. 10 discloses the cigarette box blank as shown in FIG. 9, while FIG. 10*a* presents the cigarette box blank as discloses in FIG. 9*a*.

Figure 11:
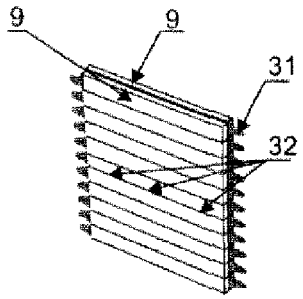
Figure 11A:
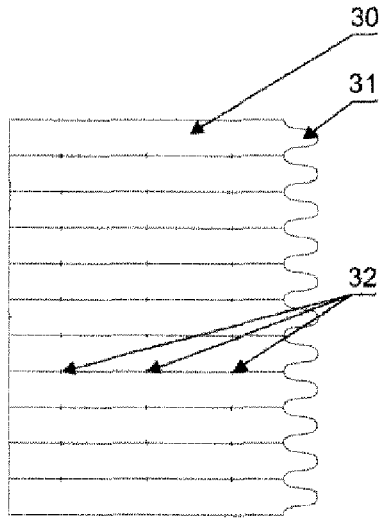
Figure 11B:
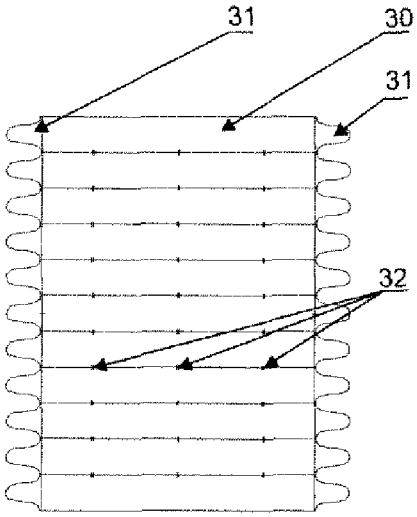

FIG. 11 presents an outlook on matches made of cardboard, whereat FIG. 11*a* and FIG. 11*b* disclose cardboard blanks of matches.

As presented in FIG. 1-FIG. 11*b*, a cigarette box as claimed has been made of cardboard and has the shape of a rectangular prism. It is formed of a storage part 1 adapted to accommodate cigarettes within and a hinged lid 2 connected with the said storage part 1 by means of an articulated joint 3 located on the rear wall 4. The front walls 5 of the lid 2 are longer than its rear wall 4 and the side walls 6 of the lid 2 are oblique. The storage part 1 is provided with an additional inside front wall 7, while the outside front wall 8 of the storage part 1 is hinged. Between the hinged front wall 8 and the inside front wall 7 there is an additional storage space for matches 9. The depth of the box C is 0.43-0.52 of the width B of the box. The inside front wall 7 features two extrusion ridges 10 and 11 oriented towards the box interior. The bottom extrusion ridge 10 of the inside front wall 7 forms a storage space for matches 9. The matches 9 are located either alongside or crosswise the box. The matches 9 can be attached to the hinged front wall 8 or to the inside front wall 7. The inside front wall 7 features in its upper part a trapezoidal cut-out with rounded corners having an additional undercutting 12, whereas the articulated joint attached to the front inside wall 7 with adjoining inside front walls 13 discloses a series of incisions 14 in its upper part. An identical incision is placed in the middle of the upper extrusion ridge 11. The outside front wall 8 has a narrowed end 15 folded under towards the interior of the box. Moreover, said wall 8 can be made either of the same substance as the rest of the box, or made of transparent substance. A variation of said wall 8 is presented in FIG. 1*a*, where the front wall 8 is formed as a double wall made of side walls 16 as discloses in FIG. 2*a*. Another variation of said front wall 8, featuring extrusion ridge 17 alongside line 18, is disclosed in FIG. 1*b*, whereas its blank is shown in FIG. 2*b*. Another variation of said front wall, as presented in FIG. 1*c*, is a variation as in FIG. 1 with extrusion ridge 17, whereat within the storage space a lighter 19 is placed. Another variation as presented in FIG. 1*d* is a variation as in FIG. 1*c*, whereat in the extrusion ridge 17 a cut-out 20 is placed. FIG. 1*e* depicts a variation of FIG. 1*b*, whereat in the extrusion ridge 17 a cut-out 20 is placed. The box as presented in FIG. 1*f* is a variation of the box as in FIG. 1, where in the front wall 8 a cut-out 20 is placed. Another variation of the box as presented in FIG. 1*g* is a variation of the box as in FIG. 1*a*, whereat its front wall 8 features a cut-out 20.

Figure 1C:
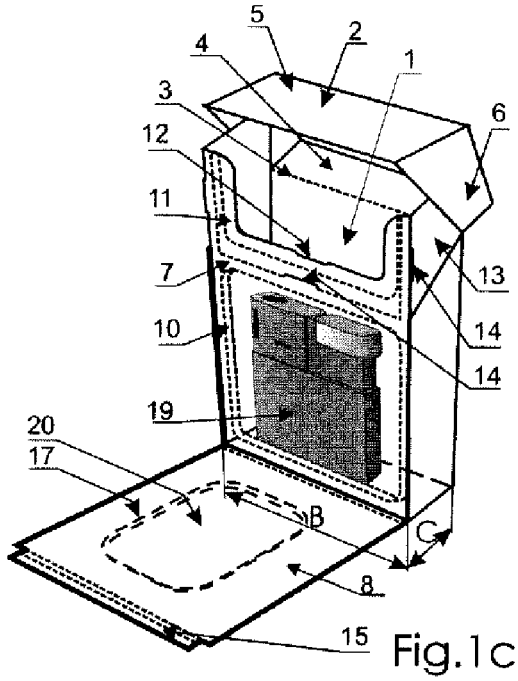
Figure 1D:
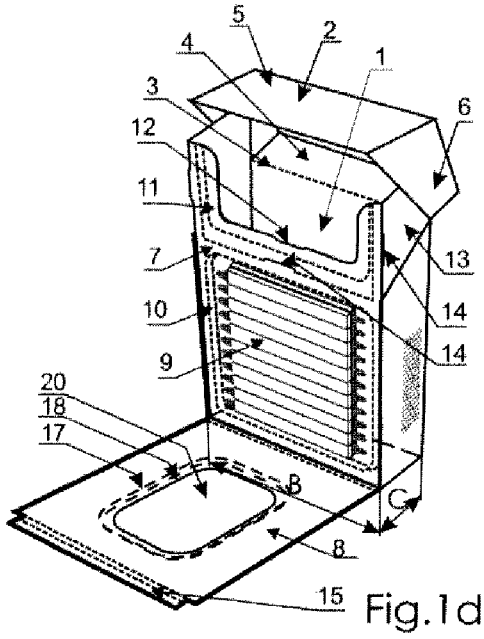
Figure 1E:
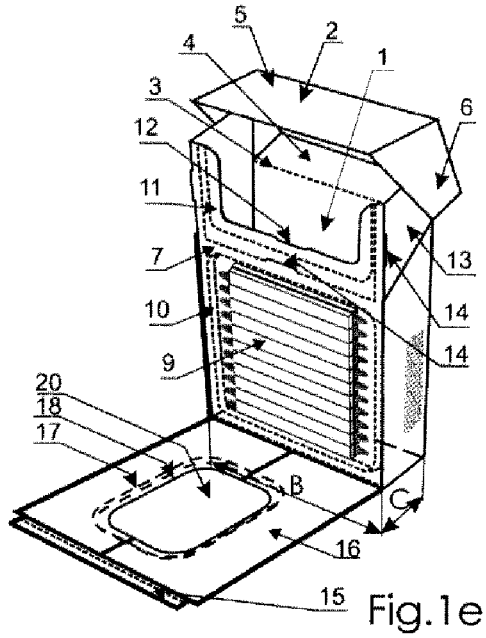
Figure 1F:
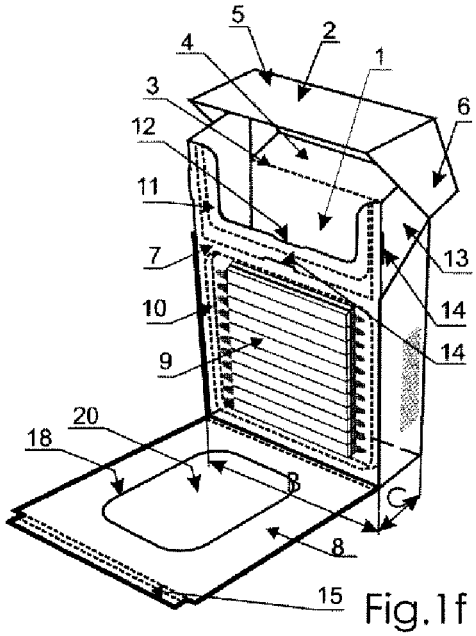
Figure 1G:
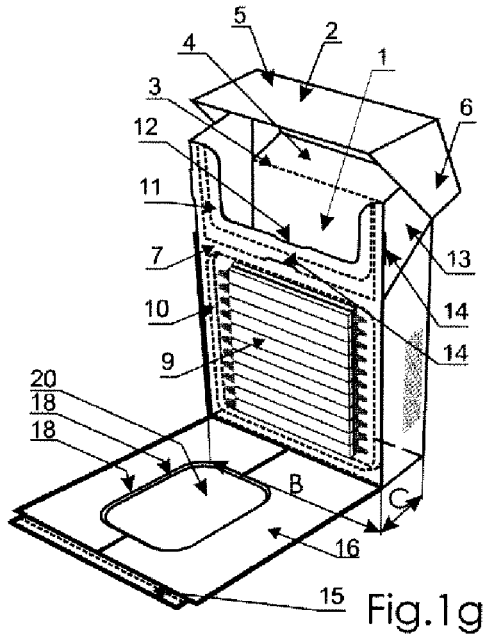
Figure 2:
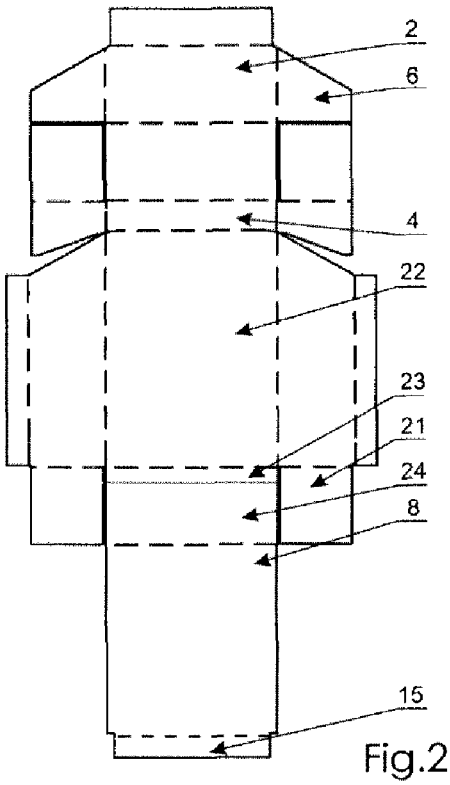
Figure 2A:
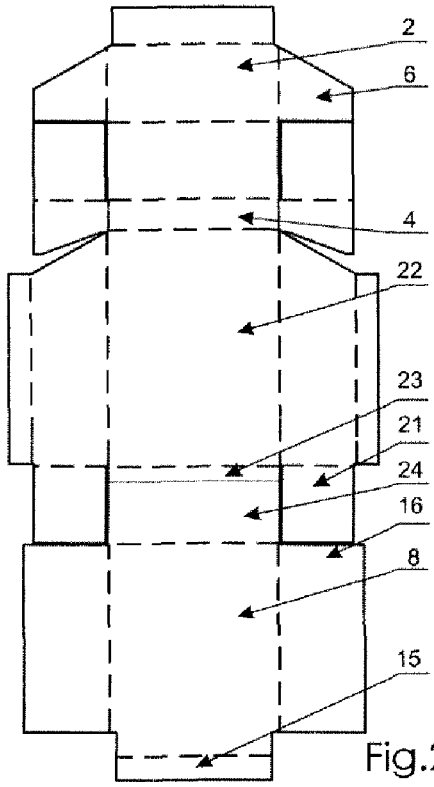
Figure 2B:
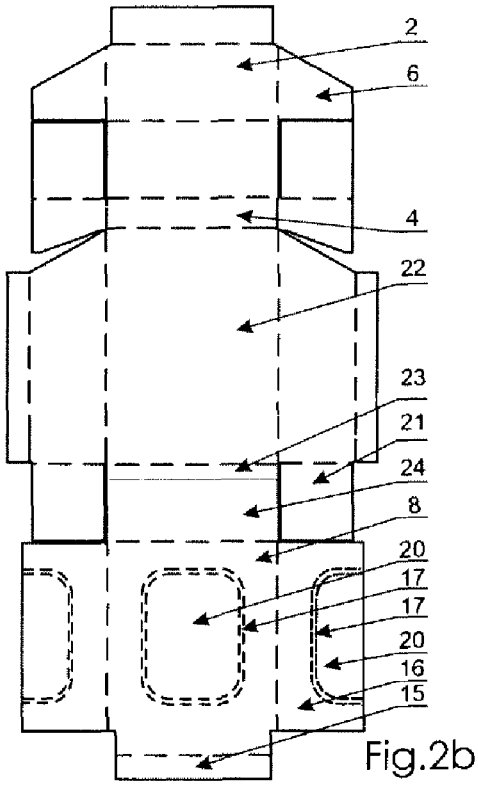
Figure 2C:
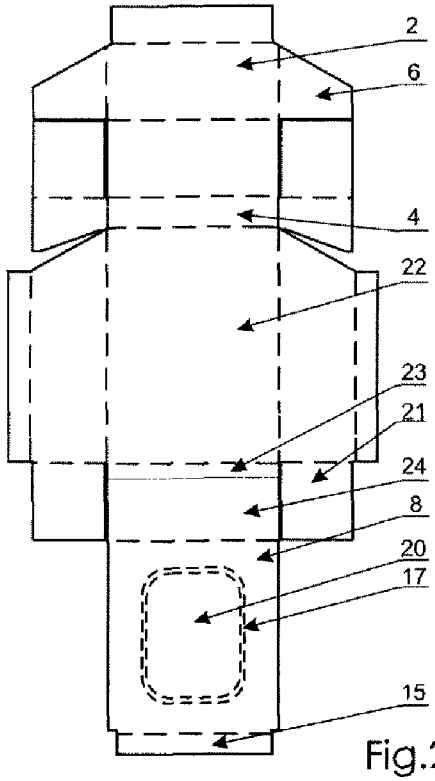
Figure 2D:
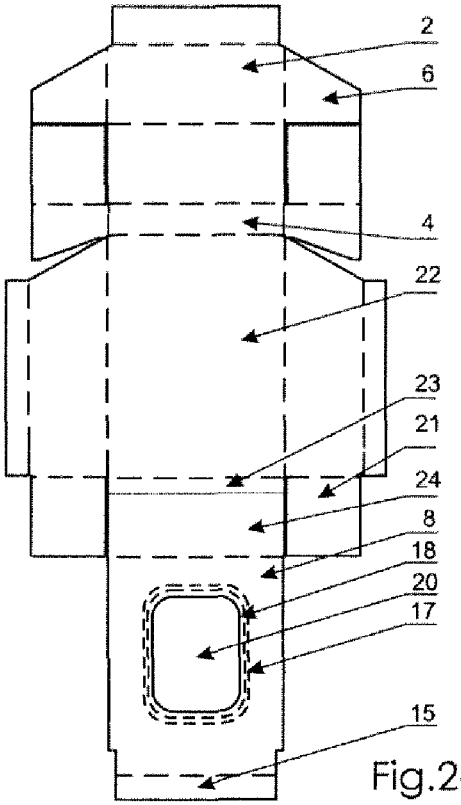
Figure 2E:
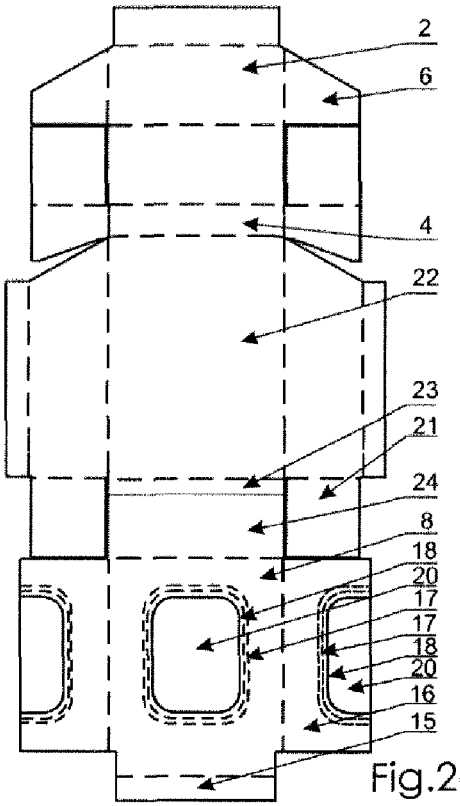
Figure 2F:
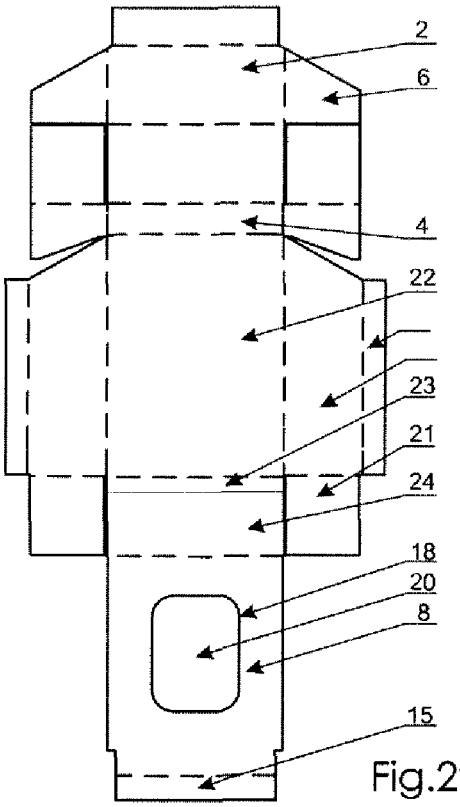
Figure 2G:
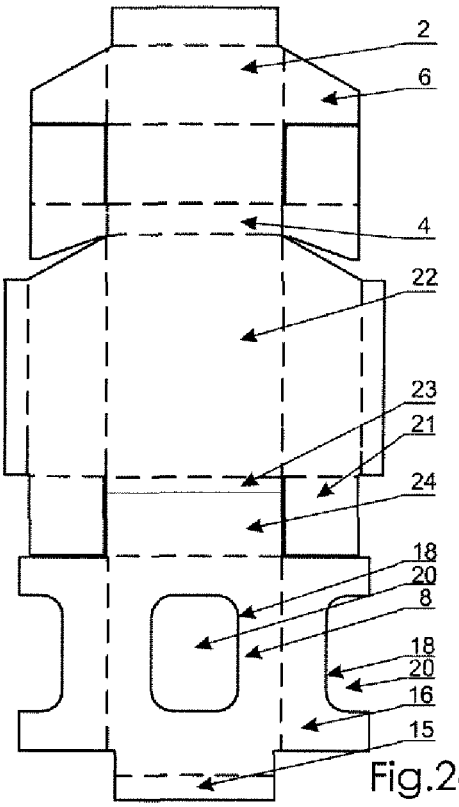

FIG. 2 discloses a blank as in FIG. 1, where all walls of the box with additional walls 21 are presented, whereas said additional walls 21 serve the purpose of joining the elements which are arranged at right angles against each other, yet are not adjacent in the blank. Moreover, the blank discloses the rear wall 22 and the bottom 23 and 24 of the box formed of two elements glued to each other. FIG. 2*a* depicts a blank as is FIG. 1*a*, whereas FIG. 2*b* presents a blank as in FIG. 1*b*, where extrusion ridge 17 is shown, both in the front wall 8 and in side walls 16. FIG. 2*c* discloses the blank as in FIG. 1*c*. The following blanks are presented in the following figures, whereat these are the blanks corresponding to the following figures:

FIG. 2*d*-FIG. 1*d*
FIG. 2*e*-FIG. 1*d*
FIG. 2*f*-FIG. 1*f*
FIG. 2*g*-FIG. 1*g*

Figure 3:
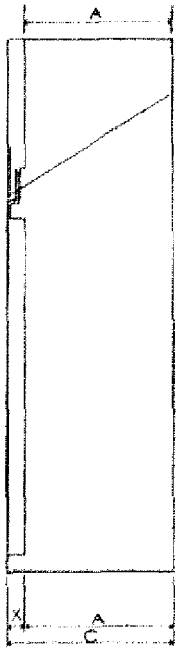
Figure 3A:
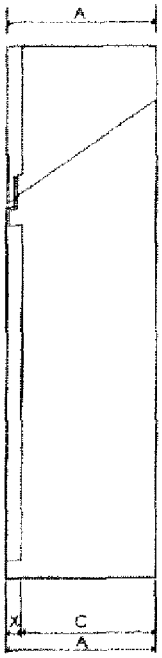
Figure 4A:
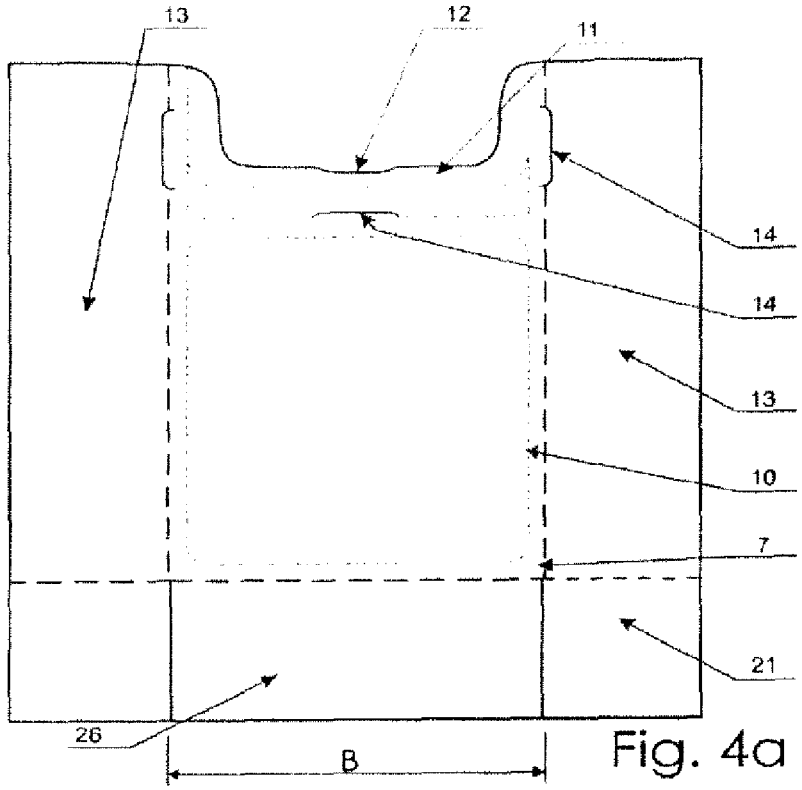
Figure 3B:
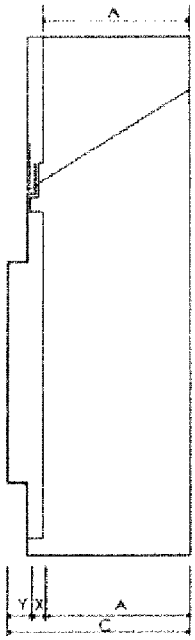
Figure 4B:
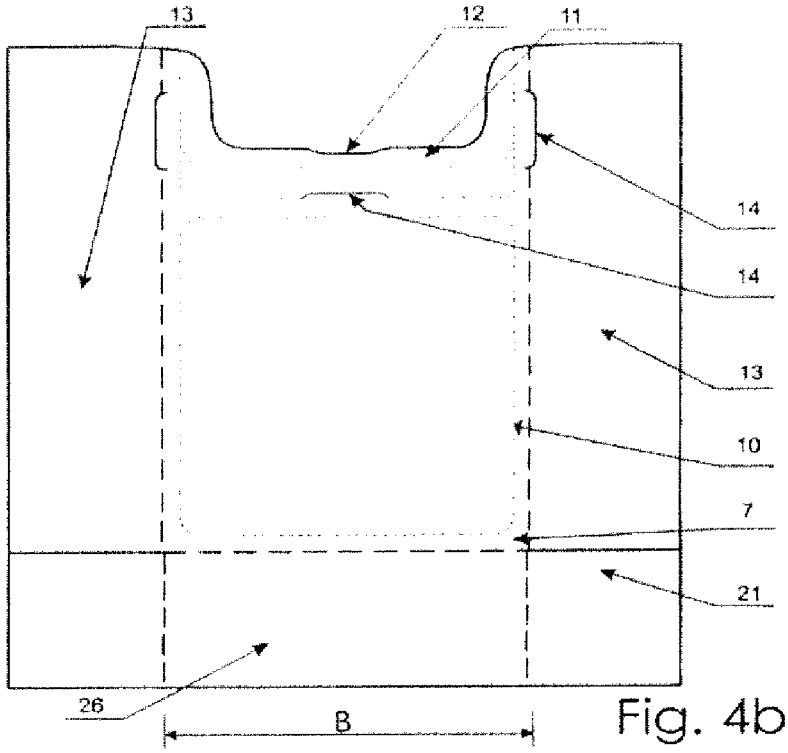
Figure 3C:
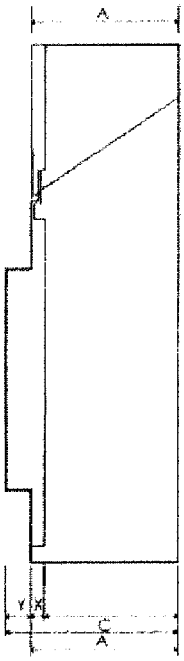

FIG. 3 discloses side view of the box, where the following magnitudes are presented:

A—former depth of the box
C—increased depth of the box
X—depth of the storage space for matches for the magnitude of 10>X>0.1 mm FIG. 3*a* also presents a side view of the box, whereat the magnitude X is a recess oriented towards the interior of the box. FIG. 3*b*, which also discloses a side view of the box, an additional magnitude Y has been introduced, which defines the dimension of the extrusion ridge 17 situated outside of the box. FIG. 3*c* presents the box, where the width of the box is increased by the magnitude of Y, which equals the dimension of the extrusion ridge 17.

Figure 4:
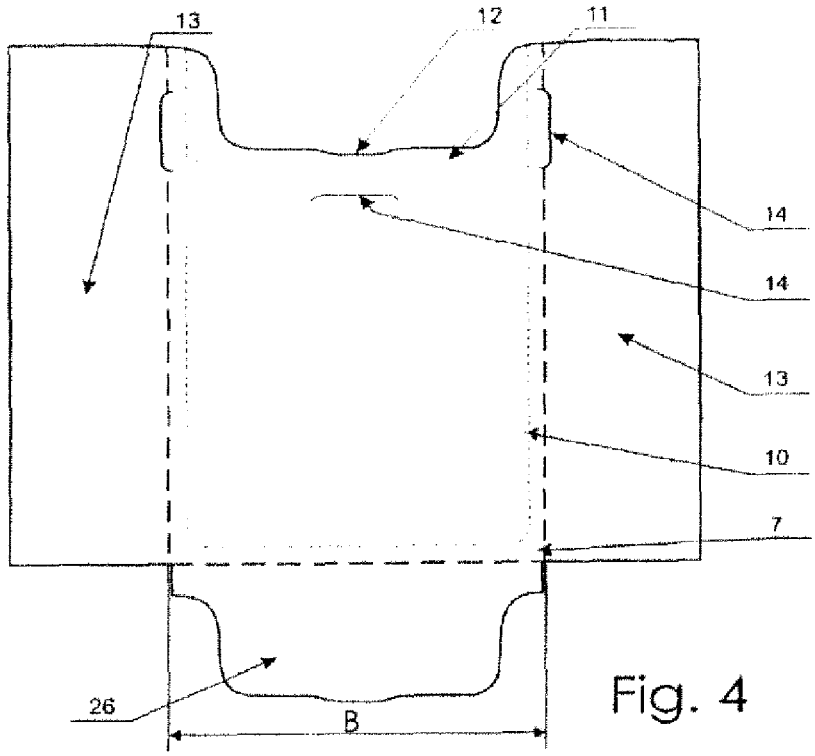
Figure 4C:
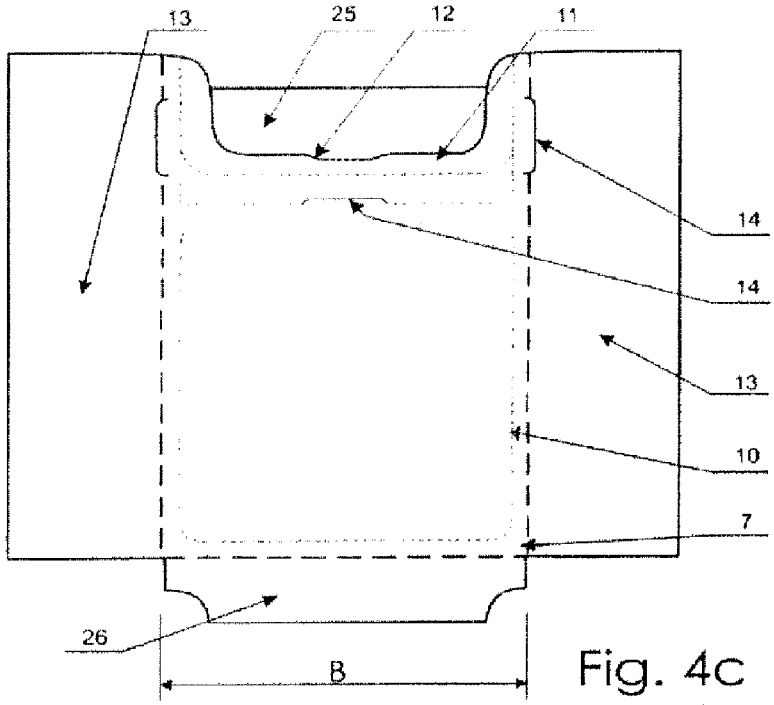
Figure 4D:
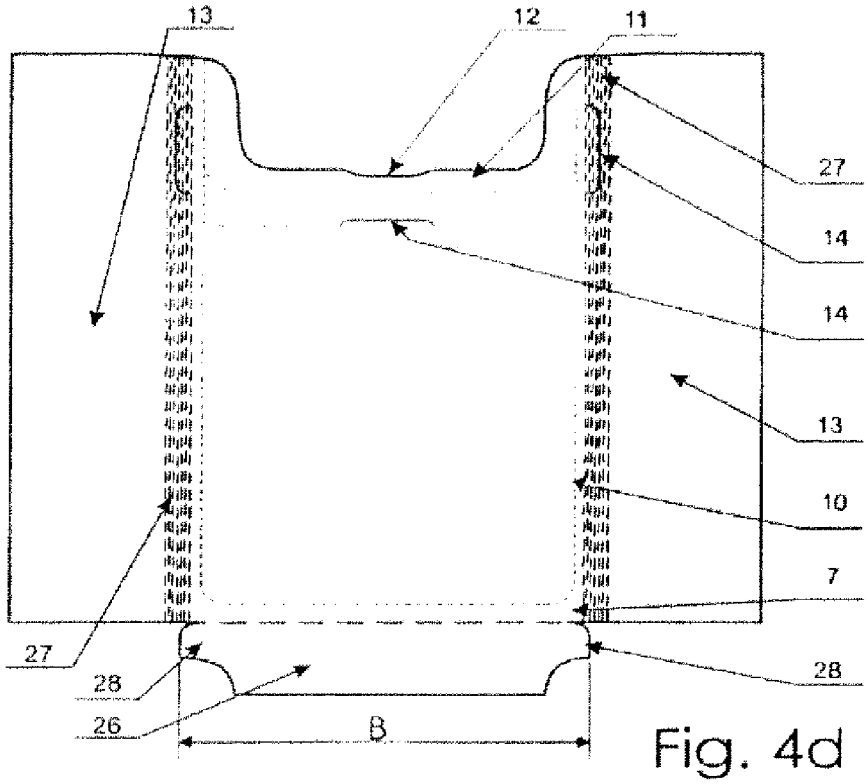
Figure 4E:
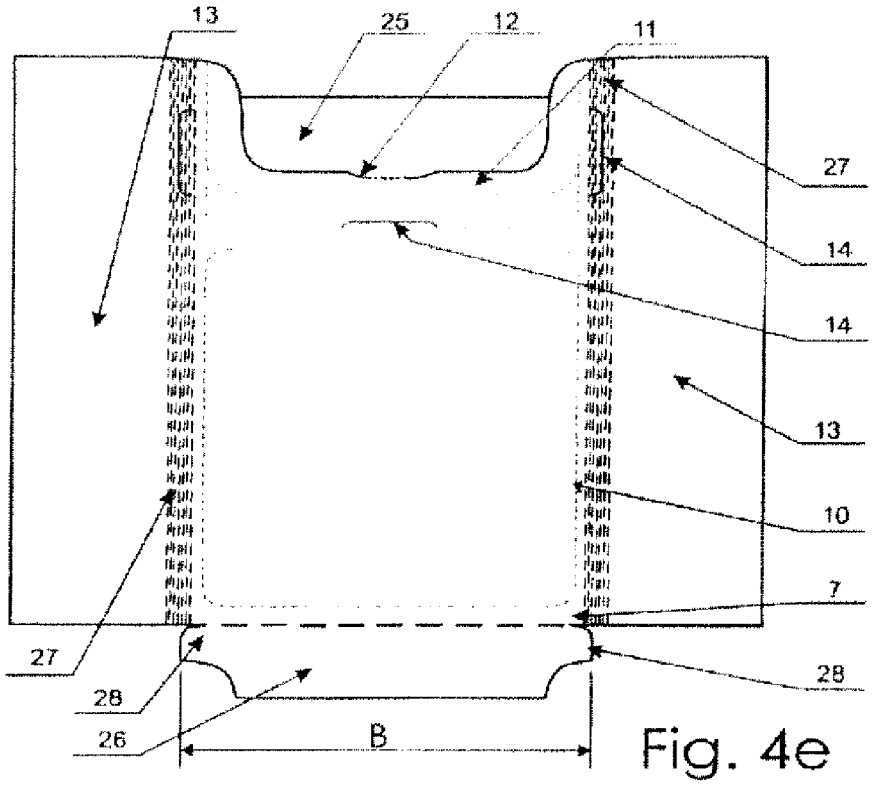
Figure 4F:
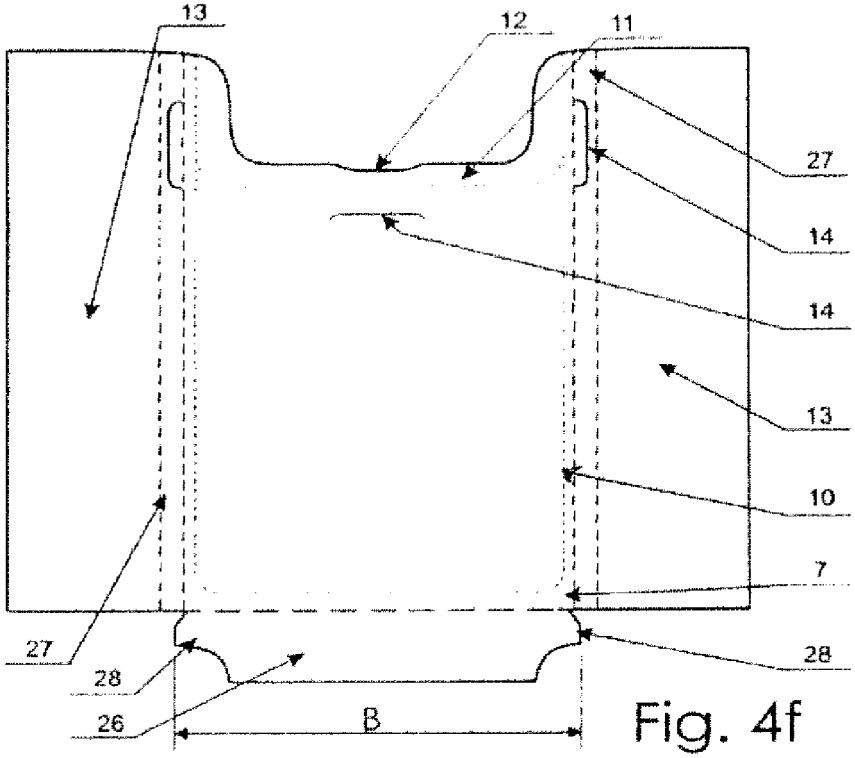
Figure 4G:
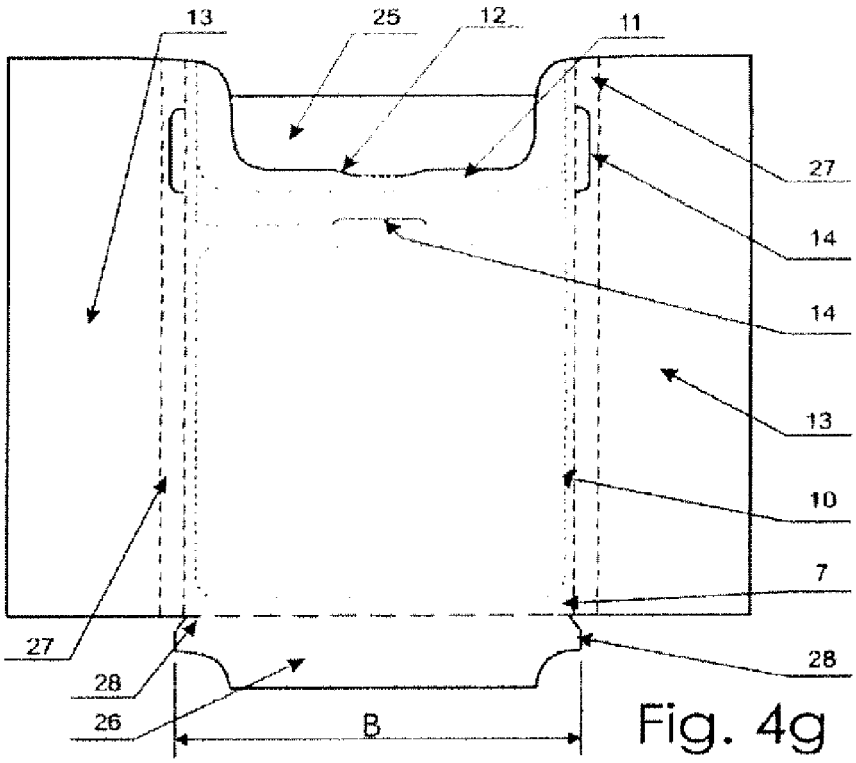

FIG. 4, FIG. 4*a*, FIG. 4*b*, FIG. 4*c*, FIG. 4*d*, FIG. 4*e*, FIG. 4*f* i FIG. 4*g* disclose the blank of the inside front wall 7 in a palette of variations, whereat the inside front wall 7 features side walls 13, an additional upper wall 25, and the bottom wall 26 in different realizations, as well as additional side walls 21 which serve the purpose of joining the vicinal walls. FIG. 4 presents the cut-out in the bottom wall 26, which reflects the cut-out situated in the upper part of the front wall 7 or top wall 25 and facilitates the process of mass production of the front wall 7. The variations of the front wall 7 as presented in FIG. 4*d*-FIG. 4*g* feature creases 27 along the side walls splices 13 and the bottom 26 of the front wall is oblique 28 and of singular shape.

Figure 6:
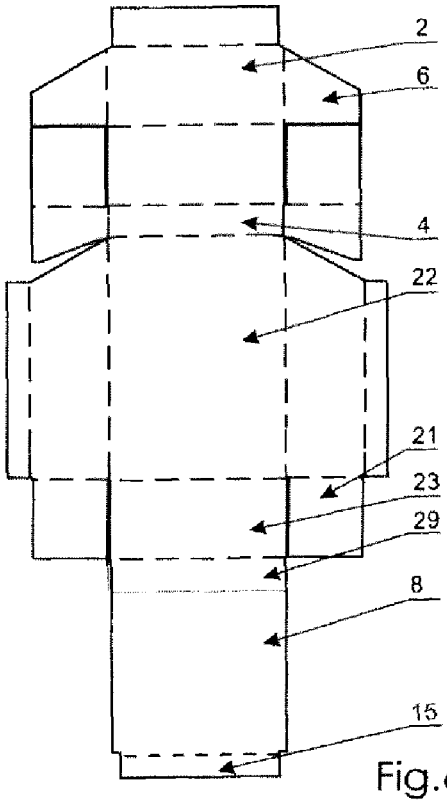
Figure 6A:
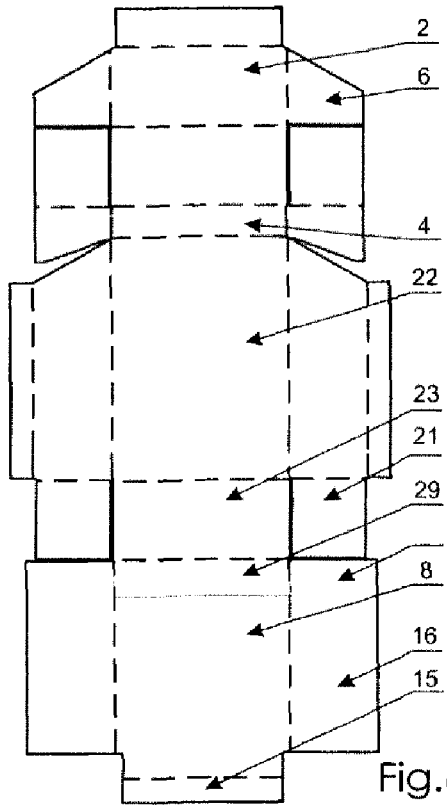
Figure 6B:
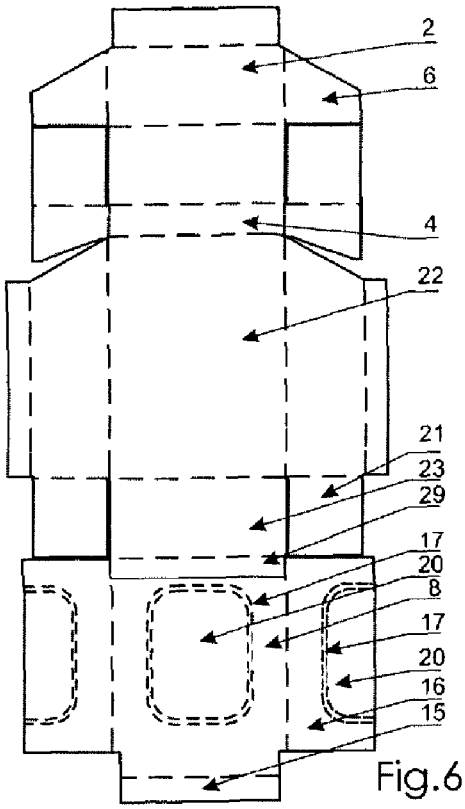
Figure 6C:
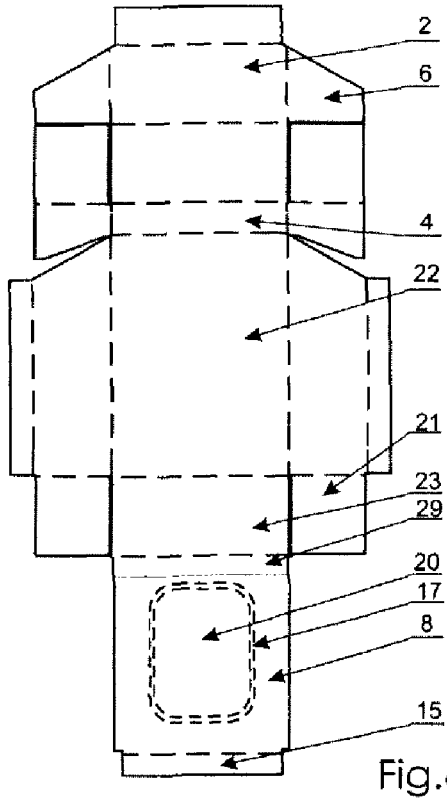
Figure 6D:
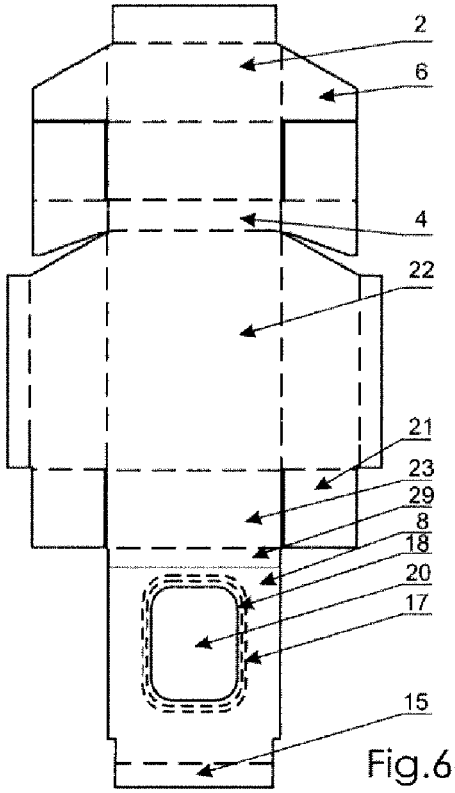
Figure 6E:
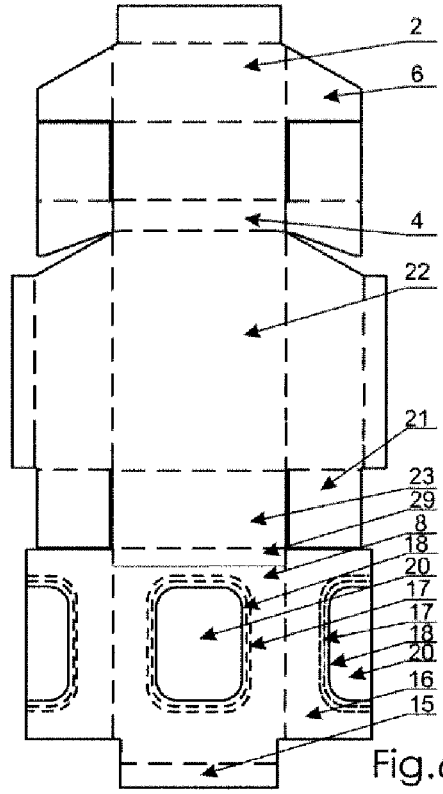
Figure 6F:
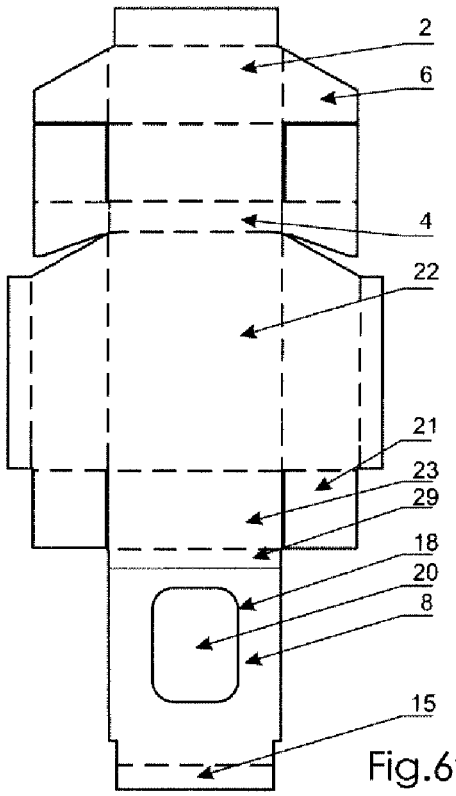
Figure 6G:
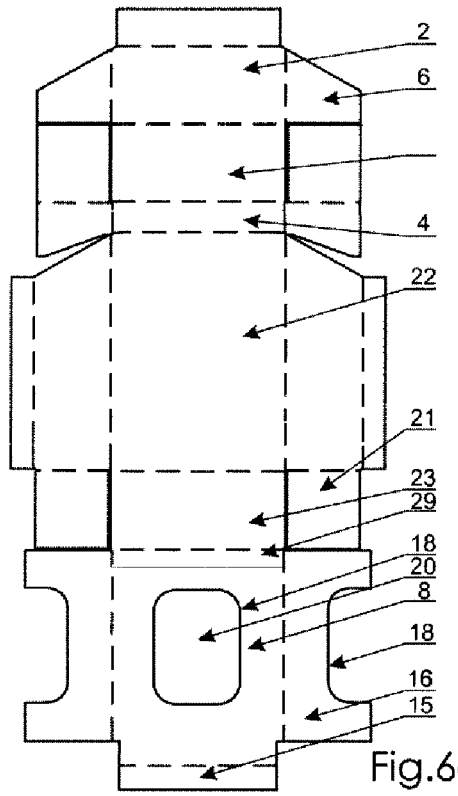

The variations of the box as presented in the following figures: FIG. 5, FIG. 5*a*, FIG. 5*b*, FIG. 5*c*, FIG. 5*d*, FIG. 5*e*, FIG. 5*f* and FIG. 5*g* are presented according to the same pattern as the box's variations as in FIG. 1, with the difference residing in that in FIG. 5 the outside front wall 8 is attached to a projection 29 being permanently fixed to the bottom wall 23 of the box. The blanks are depicted in FIG. 6-FIG. 6*g*, where the bottom of the box 23 is fitted with a projection 29, whereto the outside front wall 8 is attached.

Other variations of the box are disclosed in FIG. 7-FIG. 7*g*, where the outside front wall 8 is made of cardboard, whereat the cut-out 20 is covered with silver foil. The blanks are presented in the corresponding figures FIG. 8-FIG. 8*g*.

Other variations of the box are shown in FIG. 9, FIG. 9*a* and FIG. 10*a*. The variations disclose the box and its blank with the edges creased 27, whereat the creased edges 27 may form either orbiculations or obliquity of said edges.

Other variations of the box are depicted in FIG. 9, FIG. 9*a*, FIG. 10 and FIG. 10*a*. The variations disclose the box and its blank with the edges creased 27, whereat the creased edges 27 may form either orbiculations or obliquity of said edges. The process of creasing is applied on the splices of the side walls, i.e. within the box's storage part and on the lid. FIG. 11, FIG. 11*a* and FIG. 11*b* disclose various methods of safety matches' installation within the additional storage space, whereat the safety matches can be made of cardboard 30 and match heads 31 contain flammable substance, where after striking said match head 31 against striker said safety match initiates combustions and subsequently burns the cardboard part of the safety match 30. The matches 9 can be made of either one cardboard sheet 30 featuring incisions 32, by means of which safety matches are united into one entirety, or both cardboard sheets 30 with incisions 32 can be glued together and to the box, while the match heads 31 are situated reversely, on opposite sides.

The invention claimed is:

1. A cigarette box comprising:

a hinged lid (2) of a rectangular prism shape comprising a front wall (5), a rear wall (4), and two side walls (6), wherein the hinged lid (2) is connected to a storage part (1) having an interior adapted to accommodate cigarettes within, the storage part comprising a rear wall (22), an inside front wall (7) having a trapezoidal cut-out and an outside front wall (8), wherein the hinged lid (2) is connected to the storage part (1) by an articulated joint (3) placed on the rear wall (4) of the hinged lid and the rear wall (22) of the storage part, wherein the front wall (5) of the hinged lid is longer than the rear wall (4) of the hinged lid, and wherein the side walls (6) of the hinged lid are oblique, wherein the outside front wall (8) of the storage part is hinged, wherein the inside front wall (7) has a lower extrusion ridge (10) and an upper extrusion ridge (11) each oriented towards the box interior, wherein said lower extrusion ridge (10) of the inside front wall (7) forms a storage space between the outside front wall (8) and the inside front wall (7), wherein the outside front wall (8) has a narrowed end (15) folded over a portion of the upper extrusion ridge (11) in the direction of the interior of the box so as to fit under the hinged lid (2) when closed, wherein the outside front wall (8) of the storage part is made of the same substance as the hinged lid (2), the rear wall (22) of the storage part and the inside front wall (7), or the outside front wall (8) is made of a semi-transparent substance, or is made of a transparent substance.

2. The box of claim 1, wherein the outside front wall (8) is a double wall.

3. The box of claim 1, comprising an extrusion ridge (17) on the outside front wall (8) which is oriented towards the outside of the box.

4. The box of claim 3, further comprising matches (9) installed in rows within the storage space, wherein the match heads (31) are situated reversely in each of the rows.

5. The box of claim 1, wherein the outside front wall (8) has a cut-out (20) where an insert made of a semi-transparent or a transparent substance is placed.

6. The cigarette box of claim 1, wherein the depth of the box (A) is increased by the magnitude of 10>X>0.1 mm or decreased by the magnitude of −10<X<=0 mm of the storage space for matches (9), where said magnitude fulfills dependence of B:A=B:(C−X) where:

B—width of the box
A—former depth of the box
C—increased or decreased depth of the box
X—depth of the storage space for matches, and at the same time the inside front wall (7) has two extrusion ridges (10, 11) oriented towards the box interior, while the outside front wall has a narrowed end folded over a portion of the upper extrusion ridge (11)

oriented towards the inside of the box so as to fit under the hinged lid (2) when closed.

7. The cigarette box of claim 1, wherein the depth of the box (A) is increased by the magnitude of 10>X>0.1 mm—of the storage space for matches (9), and of the magnitude of 10>Y>=0 mm, where said magnitudes fulfill dependence of B:A=B:((C−X)−Y) where:

B—width of the box

A—former depth of the box

C—increased depth of the box

X—depth of the storage space for matches (9) for the magnitude of 10>X>0.1 mm, Y—depth of the additional storage space formed by the extrusion ridge (17) which is oriented toward the outside of the box and which appears on the outside front wall (8)—the depth protruded outwardly for the magnitude of 10>Y>=0 mm, at the same time the inside front wall (7) has two extrusion ridges (10, 11) oriented towards the box interior, whereas the outside front wall (8) has a narrowed end folded over a portion of the upper extrusion ridge (11) towards the interior of the box so as to fit under the hinged lid (2) when closed.

8. The cigarette box of claim 1, wherein the depth of the box (A) is decreased by the magnitude of −10<X<=0 mm of the storage space for matches (9) and increased by the protrusion of Y, where Y represents the magnitude of 10>Y>=0 mm, and said magnitudes fulfill dependence of B:A=B:((C−X)−Y) where:

B—width of the box

A—former depth of the box

C—increased depth of the box

X—depth of the storage space for matches,

Y—depth of the additional storage space formed by the extrusion ridge (17) which is oriented toward the outside of the box and which appears on the outside front wall (8) the depth protruded outwardly for the magnitude of 10>Y>=0 mm, at the same time the inside front wall (7) has two extrusion ridges (10, 11) oriented towards the box interior, whereas the outside front wall (8) has a narrowed end folded over a portion of the upper extrusion ridge (11) towards the interior of the box so as to fit under the hinged lid (2) when closed.

9. A cigarette box comprising:

a hinged lid (2) of a rectangular prism shape comprising a front wall (5), a rear wall (4), and two side walls (6), wherein the hinged lid (2) is connected to a storage part (1) having an interior adapted to accommodate cigarettes within, the storage part (1) comprising a rear wall (22), an inside front wall (7) having a trapezoidal cut-out and an outside front wall (8), wherein the hinged lid (2) is connected to the storage part (1) by an articulated joint (3) placed on the rear wall (4) of the hinged lid and the rear wall (22) of the storage part, wherein the front wall (5) of the hinged lid is longer than the rear wall (4) of the hinged lid, and wherein the side walls (6) of the hinged lid are oblique, wherein the outside front wall (8) of the storage part is hinged, wherein the inside front wall (7) has a lower extrusion ridge (10) and an upper extrusion ridge (11) each oriented towards the box interior, wherein said lower extrusion ridge (10) of the inside front wall forms a storage space between the outside front wall (8) and the inside front wall (7), wherein the outside front wall (8) has a narrowed end (15) folded over a portion of the upper extrusion ridge (11) in the direction of the interior of the box so as to fit under the hinged lid (2) when closed, wherein the outside front wall (8) is made of the same substance as the hinged lid (2), the rear wall (22) of the storage part and the inside front wall (7), or the outside front wall (8) is made of a semi-transparent substance, or is made of a transparent substance, wherein the outside front wall (8) optionally has an extrusion ridge (17) oriented towards the outside of the box which forms an additional storage space, wherein matches (9) are installed within the storage space, and wherein the match heads (31) are situated reversely in each of the rows.

10. A blank to obtain a cigarette box, the cigarette box comprising i) a first cutout comprising a hinged lid (2) in the shape of a rectangular prism, comprising a front wall (5), a top wall, a rear wall (4), and side walls (6), and a storage part (1) having an interior adapted to accommodate cigarettes within, comprising a storage part rear wall (22), a bottom wall (23), storage part side walls, and an outside front wall (8), wherein the outside front wall has a narrowed end (15) folded under towards the interior of the box, wherein the hinged lid (2) is connected to said storage part by an articulated joint (3) located on the rear wall (4) of the hinged lid and the rear wall (22) of the storage part, wherein the front wall (5) of the hinged lid is longer than the rear wall (4) of the hinged lid, and wherein the side walls (6) of the hinged lid are oblique, wherein the following walls are situated within the longitudinally spread blank of the cigarette box: the front wall (5) of the hinged lid, the top wall of the hinged lid, and the rear wall (4) of the hinged lid, with side walls (6) attached thereto, wherein the hinged lid rear wall (4), and the storage part rear wall (22) together with storage part side walls attached thereto are adjacent, and the storage part rear well (22) adjoins a bottom wall (23), wherein said bottom wall (23) is adjacent to the outside front wall (8) and wherein the outside front wall (8) is made of the same substance as the hinged lid (2), the inside front wall, the bottom wall, and the storage part side walls, or the outside front wall (8) is made of a semi-transparent substance, or is made of a transparent substance, and wherein the outside front wall (8) optionally has an extrusion ridge (17) oriented towards the outside of the box, and ii) a second cutout comprising an inside front well (7) and adjacent side walls (13) wherein the inside front wall (7) has a lower extrusion ridge (10) and an upper extrusion ridge (11) each oriented towards the box interior, and wherein the lower extrusion ridge (10) of the inside front wall (7) forms a storage space between the outside front wall (8) and the inside front wall (7).

11. The blank of claim 10, wherein the outside front wall (8) of the box has two additional side walls (16), wherein the additional side walls (16) are shorter than the outside front wall (8), and wherein the additional side walls (16) have extrusion ridges (17) or have no extrusion ridges.

12. The blank of claim 11, wherein the outside front wall (8) of the box and/or the additional side walls (16) feature a cut-out (20) in the extrusion ridge (17).

13. A blank to obtain a cigarette box, the cigarette box comprising i) a first cutout comprising a hinged lid (2) in the shape of a rectangular prism comprising a front wall (5), a top wall, a rear wall (4), and side walls (6), and a storage part (1) having an interior adapted to accommodate cigarettes within comprising a storage part rear wall (22), a bottom wall (23), storage part side walls, and an outside front wall (8) wherein the outside front wall (8) has a narrowed end (15) folded over towards the interior of the box, wherein the hinged lid (2) is connected to said storage part (1) by an articulated joint (3) located on the rear wall (4) of the hinged lid and the rear wall (22) of the storage part, wherein the front wall (5) of the hinged lid is longer than rear wall (4) of the hinged lid, and wherein the side walls (6) of the hinged lid are oblique, and wherein the following walls are situated within the longitudinally spread blank of the cigarette box: the front wall (5) of the hinged lid, the top wall of the hinged lid, and the rear wall (4) of the hinged lid with side walls (6) attached thereto, wherein the hinged lid rear wall (4), the storage part rear wall (22) together with the storage part side walls attached thereto are adjacent, and the storage part rear wall (22) adjoins a bottom wall (23), wherein said bottom wall (23) is adjacent to the outside front wall (8) and wherein there are creases (27) where the front wall (5) of the hinged lid meets the side walls (6) of the hinged lid, and creases where the storage part rear wall (22) meets the storage part side walls, wherein the storage part side walls adjacent to the storage part rear wall (22) are adjacent to flaps (21), wherein there are reverse creases (27) where the storage part side walls meet the flaps (21), and ii) a second cutout comprising an inside front wall (7) and adjacent side walls (13) wherein the inside front wall (7) has a lower extrusion ridge (10) and an upper extrusion ridge (11) each oriented towards the box interior, and wherein the lower extrusion ridge (10) of the inside front wall forms a storage space between the outside front wall (8) and the inside front wall (7).

14. The box of claim 2, comprising an extrusion ridge (17) on the outside front wall (8) which is oriented towards the outside of the box and which forms a storage space useful for matches or other objects.

15. The box of claim 14, further comprising matches (9) installed in rows within the storage space, wherein the match heads (31) are situated reversely in each of the rows.

16. The box of claim 2, wherein the outside front wall (8) has a cut-out (20) where an insert made of a semi-transparent or transparent substance is placed.

* * * * *